United States Patent [19]

Hough et al.

[11] Patent Number: 4,602,985

[45] Date of Patent: Jul. 29, 1986

[54] CARBON CELL ELECTRODES

[75] Inventors: Paul T. Hough, Kanata; Dunja M. Novak-Antoniou, Ottawa, both of Canada

[73] Assignee: Eldorado Resources Limited, Ontario, Canada

[21] Appl. No.: 730,858

[22] Filed: May 6, 1985

[51] Int. Cl.[4] ..... C25B 1/24

[52] U.S. Cl. ..... 204/60; 204/294

[58] Field of Search ..... 204/59 AM, 60, 294

[56] References Cited

U.S. PATENT DOCUMENTS

| | | | |
|---|---|---|---|
| 2,494,425 | 1/1950 | Bakker | 204/294 |
| 3,146,179 | 8/1964 | Davies | 204/60 |
| 4,176,018 | 11/1979 | Faron et al. | 204/60 |
| 4,203,821 | 5/1980 | Cramer et al. | 204/294 |
| 4,235,695 | 11/1980 | DeNora et al. | 204/290 R |
| 4,375,395 | 3/1983 | Foller et al. | 204/294 |

*Primary Examiner*—John F. Niebling
*Assistant Examiner*—Terryence Chapman
*Attorney, Agent, or Firm*—Wenderoth, Lind & Ponack

[57] ABSTRACT

Improved carbon electrodes, for use as anodes in an electrolytic cell for the generation of fluorine from a melt having the approximate composition KF.2HF, which show an improvement in cell efficiency are described. In contrast to the known fluorine cell electrodes which have a rough surface, the electrodes of this invention have smooth, polished, surfaces. A method of polishing known electrodes is also described, wherein a liquid polishing medium is used. The liquid chosen affects to a small degree the efficiency improvement obtained.

6 Claims, No Drawings

CARBON CELL ELECTRODES

This invention is concerned with carbon electrodes, particularly with amorphous carbon electrodes used as anodes in the electrolytic generation of fluorine gas.

In the electrolytic production of fluorine gas, the commonly used commercial cells comprise essentially four basic parts. The cell itself comprises an electrolyte resistant container, usually provided with means to maintain electrolyte temperature, and to replenish depleted electrolyte with further hydrogen fluoride. The cathode used is generally a mild steel plate. Several electrolytes have been used at one time and another since the first successful production of fluorine from a fused salt melt. The electrolyte usually used has the approximate composition KF.2HF although this ratio is not necessarily adhered to precisely. Generally the cell is operated at a temperature of around 80° to 95° C., at which the electrolyte is a reasonably fluid liquid. The cell also will contain a gas separation means, as the generated hydrogen (at the cathode) and fluorine (at the anode) have to be kept apart to avoid spontaneous—and often violent—reformation of hydrogen fluoride.

In modern practice, the anode used in such a cell generally is made of carbon. It has been found that provided the manufacturing process is controlled to avoid as much as possible the formation of graphitic carbon, then such an amorphous carbon electrode has a reasonable cell life. The presence of graphitic carbon is believed to result in carbon-fluorine reactions which markedly impair both the efficiency (for example as expressed by the amount, in watt-hours, of electricity consumed to produce a given amount of fluorine) and the life of a carbon electrode. Thus the carbon electrodes commonly used as anodes in electrolytic cells generally comprise a shaped mass of compressed amorphous carbon. Whilst different cell configurations are known, in commercial cells the carbon anodes are usually approximately planar, although smaller laboratory cells have used other geometric shapes.

Although fluorine has now been produced electrolytically from a fused salt melt for around a century, it is still true to say that the nature of the electro-chemical processes which occur at the carbon electrode in a fluorine producing cell are still largely unexplained. For although the overall chemical equation is apparently straightforward—the discharge of fluorine ions to provide molecular fluorine—the nature of the processes involved whereby this happens appear to be complex. For example, although the commonly used electrodes are made from a relatively small size aggregate particle, it is known that the electrodes are porous, having a free internal volume of around 20 to 25% of the apparent overall volume of the electrode: we have observed that a major proportion of the generated fluorine leaves the electrode via internal pathways provided in the electrode by this porosity, rather than as gas bubbles detaching from the outside surface of the electrode. It is also to be noted that the commonly used electrodes have a somewhat rough surface, although both the texture, and the porosity, are known to differ both between different electrodes from the same makers to some degree, and also to a higher degree between electrodes from different makers.

It has also been suggested that this rough surface is of some importance, at least in part in view of known chlorine cell technology. It has also been recorded that new electrodes which gave unacceptable performance in a cell have been found to provide acceptable performance after their surfaces had been roughened to increase their surface area.

We have now discovered that the surface texture of fluorine electrolytic cell carbon anodes is extremely important. We have now discovered that both providing a polished surface, and the conditions under which that polished surface is obtained, markedly affect the efficiency of fluorine electrolytic cell carbon anodes. In this context, by "efficiency" we mean the amount of electricity consumed in a given cell to produce a specified amount of fluorine. For a commercial cell, this amount generally is measured in kilowatt hours. We have now discovered that polishing fluorine cell carbon anodes smooth significantly improves the overall cell efficiency, and, further, that the actual procedure used in polishing the electrode surfaces also affects the amount of improvement obtained.

Thus in its broadest aspect this invention provides a carbon electrode for use as a fluorine generating anode in a cell for the electrolytic production of fluorine gas from a potassium fluoride-hydrogen fluoride molten electrolyte having the approximate composition KF.2HF comprising a body of compressed substantially non-graphitic porous carbon having a substantially smooth, polished, surface.

Preferably, all of the electrode surfaces in contact with the electrolyte are polished.

The manner in which the polishing is carried out depends essentially on the size of the electrode to be polished. For small laboratory-size cells hand polishing techniques using graded abrasive materials are sufficient. As the pieces of carbon to be polished get larger, however, mechanised methods can be used. For the large electrodes used in a commercial fluorine cell, we have successfully used equipment closely similar to that used by stone masons for polishing rock surfaces, for example marble tomb stones and other decorative pieces. For such procedures stone masons commonly have available a range of polishing wheels, of different materials and grit sizes. A wheel should be chosen to give the smoothest possible surface texture. This may require—as is the case with hand polishing—the use of two or more different wheels in sequence. In this process, it appears that the actual polishing is effected by a mix of abrasive particles in a liquid that is between the polishing and polished surfaces. The polishing surface is a sandstone or grit wheel, which is rotated with a liquid plus particles mixture on its surface. Careful control of the operation controls the degree of smoothness obtained in the polishing step. For smaller pieces for laboratory size fluorine cells, hand polishing using a sequence of standard "wet or dry" type papers starting with 240 grit, and working through 320, 400 and 600 grit is adequate. These papers are used with a liquid polishing medium; they are not used in the dry state. This can be followed by a diamond grit polish, using 15$\mu$ and 0.25$\mu$ diamond grit in sequence, using 'Metadi' (trade mark; a commercial kerosene based lubricant commonly used in polishing geological and metallurgical samples) as the lubricant.

For both the large scale stone mason procedures, and the small scale hand-operated procedures, the polishing of the carbon electrode is always carried out using a combination of an abrasive material and a liquid medium. It has been found that the liquid medium chosen is of considerable importance. Although the liquid used appears to have no discernible effect on the quality of the polished surface obtained, insofar as its smoothness, or otherwise, is concerned, the choice of liquid used does have one observable effect on the performance of the electrode. To date, all attempts to identify any quantifiable effect on the carbon of the electrode by the liquid medium used in the polishing step have failed. Nevertheless, electrode performance investigation clearly shows that the choice of the liquid medium does influence the properties of the carbon material obtained insofar as its use as a fluorine cell anode is concerned.

We have now discovered that the use of a water soluble polar organic solvent, either alone, or admixed with water, as the liquid medium in the polishing step affects the properties of the carbon insofar as its efficiency as a carbon anode in a fluorine cell is concerned. We have now observed that the presence of a polar water soluble organic solvent in the liquid polishing medium can enhance the improved cell efficiency obtained when the carbon anode is polished in the presence of water.

Thus in a second broad aspect this invention provides a process for the preparation of a carbon electrode for use as a fluorine generating anode in a cell for the electrolytic production of fluorine gas from a potassium fluoride-hydrogen fluoride fused salt melt having the approximate composition KF.2HF which comprises polishing a body of compressed non-graphitic porous carbon having the desired geometrical shape with at least one solid abrasive in the presence of a liquid polishing medium until a desired degree of smoothness is obtained, wherein the liquid polishing medium is chosen from water and water soluble polar organic solvents, or mixtures thereof.

Preferably, all of the electrode surfaces which will be in contact with the electrolyte are polished.

Further, it is also preferred that the polishing step be continued using a sequence of abrasive materials to obtain the smoothest surface possible.

The choice of the organic solvent investigated was limited by essentially two factors: water solubility and polarity. The reason for this limitation is to ensure that the anode can be easily and adequately cleaned after polishing, by a waterwash method. The cheapest and most readily available substances fitting these criteria are the lower alcohols: methanol, ethanol, and the propanols. Additionally, the lower polyhydroxy compounds, such as ethylene glycol and glycerol, are also of interest. Lower ketones, such as acetone and 4-methyl pentan-2-one (otherwise known as "MIBK" or methyl isobutylketone) also fit this definition, as also does acetonitrile (also known as methylcyanide, $CH_3CN$), and tetrahydrothiophen-1,1-dioxide (also known as sulpholane).

Exactly how, or even why, the use of these organic materials in, or as, the liquid used in the polishing step should affect the anodic properties of the carbon being polished is not understood. It is clear, however, that they do so affect the carbon. In other words, although a marked and significant cell efficiency improvement is obtained using a polishing liquid, the degree of improvement appears to vary from liquid to liquid. It is to be noted, though, that the choice of liquid only affects the degree of improvement, in that the difference between, for example, the use of water and methanol although significant is far smaller than the difference between a conventional unpolished electrode and one polished using water as the liquid medium.

It is noted above that both the electrode processes in general, and the effects of the polishing herein described in those processes, are not fully understood; in terms of cell efficiency, the observed situation is that the use of a polished electrode, as compared to an unpolished electrode, decreases the voltage required in order to make the cell work to produce the desired fluoride gas. This voltage decrease directly affects the power consumed by the cells as recorded in kilowatt hours.

In order to assess the capabilities as a fluorine cell anode of a given piece of carbon, there are essentially three approaches which can be adopted. The most meaningful in fact is the more difficult; it is to use the carbon in question in a fluorine generating cell of some size, and thereby obtain cell efficiency data. The chief disadvantage with this procedure as a method of investigation is that thirty to seventy (depending upon cell size) electrode pieces need to be prepared, and a large cell operated under carefully controlled conditions. Whilst such large scale experiments do give directly the desired data on cell efficiencies, nevertheless small scale electrode assessment procedures are desirable. Experiments using a pilot scale cell can be utilized, wherein the cell contains one pair of electrodes (rather than the 40 or so in a full scale cell), each of which are the same size as the full scale cell electrodes. This method also gives directly data on cell efficiencies, but also again requires the preparation of at least one full size large electrode for test purposes. As an alternative third approach, a cyclic voltammetry procedure (described in more detail below in the context of the Examples) can be used. This is carried out in a relatively small laboratory scale test cell, using quite small carbon anodes, of about 5.0 $cm^2$ to 25.0 $cm^2$ size. Further, it is possible to use a test cell arrangement whereby several, for example 3, anode test pieces can be assembled into the cell anode compartment at one time, thus eliminating some of the cell dismantling and reassembly involved in testing. This multiple anode procedure is particularly useful in comparing a polished and unpolished electrode cut from the same carbon sample.

Comparison experiments have shown that the level of improvement that can be predicted from the cyclic voltammetry, and which can be observed in a pilot scale cell, is generally also observed in a full scale cell test.

EXAMPLES

In some of the following Examples reference is made to cyclic voltammetry techniques. These experiments use a standard test cell (see D. M. Novak, P. T. Hough; J. Electroanal. Chem, 144, 121 (1983) for details) modified to accept three anodes for testing in the anode compartment. One anode is in the center of the cell, with the two others spaced equally from it. Although this means that all three anodes are not equally spaced from the cathode, tests have showed that the current-voltage characteristics in all three positions are comparable.

The cyclic voltammetry procedure used is as follows. In the potentiodynamic cyclic voltammetry measurements the potential of the working electrode is changed at a constant controlled rate while the current associated with the potential is monitored. The result is a plot of current (y-axis) versus potential in volts (x-axis) in which the shape of the curve depends on the type of reactions occurring at the electrode surface. (For more details concerning this procedure reference can be made to: F. G. Will et al, Z. Elektrochem., 64, 258

(1960) and to D. Stonehart et al., Proc. Roy-Soc, (London) A310, 541 (1969).) In the experiments reported below, the standard electrode used as the reference electrode is an $(\alpha+\beta)$ PdH electrode. The measurements are carried out in a KF.2HF molten electrolyte maintained at 81° C. using a controlled immersed stainless steel (AISI 347) clad electrical heating element. In these experiments the potential was cycled from zero up to a chosen maximum, and then reduced to zero at the same rate.

EXAMPLES 1 to 10

In these tests a range of carbon electrode samples each cut from the same commercial-size electrode were first polished using a variety of liquid media, and then subjected to cyclic voltammetry using the procedure outlined above. Two sweep conditions were used, up to maximum potentials of 6.0 V and 7.0 V. The results are summarized in the following Table I.

TABLE I

| Example No. | Polishing Liquid | Current Density, A $cm^{-2}$ at 6.0 V | at 7.0 V |
|---|---|---|---|
| 1 | Methanol | 0.124 | 0.208 |
| 2 | Ethanol | 0.106 | 0.229 |
| 3 | N—propanol | 0.116 | 0.254 |
| 4 | "MIBK" (3) | 0.132 | 0.260 |
| 5 | Acetonitrile | 0.117 | 0.251 |
| 6 | Ethylene glycol | 0.089 | 0.165 |
| 7 | Water | 0.106 | 0.230 |
| 8 | [Unpolished] (1) | 0.111 | 0.097 to 0.122 |
| 9 | Acetone | 0.087 | 0.193 |
| 10 | Methanol soak & (2) water polish | 0.078 | 0.193 |

Notes:
(1) Comparison Example. The data given in the 7.0 V column reflects the observation that the electrode to a degree was unstable, in that repeated sweeps gave different maxima, and also gave different current results depending on whether the potential was rising or falling. This is not unusual behaviour for an unpolished electrode. The polished electrodes do not show this difference.
(2) This was one attempt of many to try and identify a cause for the observed behaviour. Before polishing the electrode piece was soaked in methanol. A significant improvement was still obtained.
(3) Methylisobutylketone, or 4-methyl pentan-2-one.

In each case the test samples were polished in sequence with 240, 320, 400 and 600 grade papers, followed by diamond polishing using 0.25$\mu$ diamond grit with Metadi lubricant. After polishing, each sample was ultrasonically cleaned in water and then dried before testing.

These results show that simple polishing of the anode samples improves significantly the obtainable current density at 7.0 V. Whilst the data is not sufficient to rank these liquids, it does indicate that each does not have the same effect on anode performance.

EXAMPLES 10 to 17

A number of tests were also run using a pilot scale cell. The electrolyte again was KF.2HF, and the cell temperature approximately 81° C. The carbon anodes used were each approximately 50 cm×20 cm×5 cm, thus having a total surface area of approximately 0.25 $m^2$. In each case where the electrode was polished, water was used as the polishing liquid. Polishing was effected using the stone mason technique, with a grit wheel. After polishing, the electrodes were water washed and allowed to air dry. The results are summarized in Table II.

TABLE II

| Example No. | Anode Surface Condition | Cell Characteristics Current, A | Voltage, V |
|---|---|---|---|
| 10 | Unpolished | 79.4 | 8.64 |
| 11 | Unpolished | 80.7 | 8.45 |
| 12 | Polished | 79.1 | 7.67 |
| 13 | Polished | 80.0 | 8.10 |
| 14 | Unpolished | 90.1 | 8.71 |
| 15 | Polished | 89.8 | 7.93 |
| 16 | Polished | 90.1 | 8.25 |
| 17 | Polished | 90.2 | 8.44 |

The mean voltage value for the polished anodes is 8.07 V, whilst that for the unpolished anodes is 8.60 V; the mean current values are for the polished anodes 85.8 A and for the unpolished anodes 83.4 A.

EXAMPLES 18 and 19

A comparative experiment was run on a full scale commercial cell in order to obtain direct data on overall cell efficiencies. In this case the cell was run long enough to obviate any transient fluctuations in the performance of the cell. Data was also obtained for the performance of a similar cell using standard electrodes without any polishing. This data is summarized in Table III.

TABLE III

| Example No. | Anode Surface Condition | Cell Voltage Range | Average | Current Efficiency Range | Average |
|---|---|---|---|---|---|
| 18 | Unpolished | 9.0–9.8 | 9.4 | 75–94 | 84.6 |
| 19 | Polished | 8.4–9.2 | 8.76 | 86–100 | 95.6 |

In each case, data was recorded over a 3 month period. The cells again use a KF.2HF electrolyte, and each cell contains 32 carbon anodes. The anodes were polished using the stone mason technique, followed by water washing and oven drying.

We claim:

1. In a process for the electrolytic production of fluorine gas from a potassium fluoride-hydrogen fluoride molten electrolyte having the approximate composition KF.2HF where a carbon electrode is used as a fluorine generating anode, the improvement comprising said electrode comprising a body consisting essentially of compressed non-graphitic carbon having a substantially smooth, polished, surface.

2. An electrode according to claim 1 wherein all of the electrode surface which contacts the electrolyte is a substantially smooth, polished, surface.

3. An electrode according to claim 1 wherein the substantially smooth, polished, surface has been obtained by polishing a body of compressed non-graphitic carbon with at least one abrasive in the presence of a liquid.

4. An electrode according to claim 1 wherein the substantially smooth, polished, surface has been obtained by polishing a body of compressed, non-graphitic carbon with at least one abrasive in the presence of a liquid chosen from water, polar organic water soluble solvents, and mixtures thereof.

5. An electrode according to claim 1 wherein the substantially smooth, polished, surface has been obtained by polishing a body of compressed, non-graphitic carbon with at least one abrasive in the presence of a liquid chosen from water, or a polar organic solvent chosen from methanol, ethanol, n-propanol, 4-methyl pentan-2-one; acetonitrile; ethylene glycol; acetone; and tetrahydrothiophen-1,1-dioxide, or from mixtures of said polar organic solvents with water.

6. An electrode according to claim 1 wherein the substantially smooth, polished, surface has been obtained by polishing a body of compressed, non-graphitic carbon with at least one abrasive in the presence of water.

* * * * *